United States Patent [19]

Petty et al.

[11] Patent Number: 4,491,077

[45] Date of Patent: Jan. 1, 1985

[54] VIBRATING HEARTH BURNERS

[75] Inventors: Michael H. Petty, Newcastle upon Tyne; Kenneth Tidd, Wokingham, both of England

[73] Assignee: Richardsons Westgarth & Co., Ltd., England

[21] Appl. No.: 293,896

[22] Filed: Aug. 18, 1981

[30] Foreign Application Priority Data

Aug. 20, 1980 [GB] United Kingdom ..... 8027135
Mar. 26, 1981 [GB] United Kingdom ..... 8109486

[51] Int. Cl.[3] ..... F23N 7/10; F23N 7/16

[52] U.S. Cl. ..... 110/278; 110/165 R; 110/281; 414/156

[58] Field of Search ..... 110/278, 281, 282, 165 R; 126/170, 174; 414/156

[56] References Cited

U.S. PATENT DOCUMENTS 2,007,601 7/1935 Fox et al. ..... 110/328
4,250,818 2/1981 Sigg ..... 110/281 X

FOREIGN PATENT DOCUMENTS 202640 10/1908 Fed. Rep. of Germany .
967356 11/1957 Fed. Rep. of Germany .
588710 6/1947 United Kingdom .
686590 1/1953 United Kingdom .

*Primary Examiner*—Edward G. Favors

*Attorney, Agent, or Firm*—Howard L. Rose

[57] ABSTRACT

The invention relates to vibrating hearth burners. Three problems exist in known such burners, these being uniformity of fuel combustion; ash discharge; and overheating of the grate. To meet the first of these, the present invention provides a burner in which the grate (30) and the vibrating mechanism (10,16) cooperate to decelerate the movement of fuel along the grate (30) as it travels towards the discharge end. This results in a build-up of ash towards the discharge end providing a substantially uniform thickness of fuel/ash on the grate (30), and a substantially uniform pressure drop across the grate (30). The provision of an ignition grate (32) is also contemplated to ensure that the fuel is ignited at the delivery end of the grate (30). To meet the second, the invention contemplates the provision of an ash return chute (54) incorporated in the vibrating grate assembly (8). Ash is discharged into the chute from the front end of the grate (30), and the vibrating assembly (8) keeps the ash in motion as it returns to the rear end adjacent the delivery end of the grate (30) for discharge. The third problem is mitigated by the construction of the grate with transversely laid bars (54). While additionally enhancing the air flow through fuel on the grate (30), transversely laid bars inhibit distortion of the grate (30) by differential expansion due to the heat generated thereon.

10 Claims, 4 Drawing Figures

VIBRATING HEARTH BURNERS

BACKGROUND TO THE INVENTION

The invention relates to vibrating hearth burners for use for example in solid fuel boilers and vapour generators. It is especially directed to such burners which can be used in boilers previously adapted for other fuels such as oil or gas.

The current energy crisis has prompted reconsideration of the use of solid fuel in various generation systems, particularly boilers and vapour generators. Primary factors in designing solid fuel systems are efficient combustion and ash removal, problems which do not arise where other fuels are used. The use of fluidized beds has greatly increased combustion efficiency, but on low capacity burners particularly it is difficult to achieve this with the simultaneous removal of fuel ash. Vibrating hearths, or travelling grates have been proposed in which the fuel moves along the grate as it burns such that the ash is discharged at the downstream end as fresh fuel is delivered at the upstream end, but while this provides a solution to the problem of ash removal it is not possible to ensure simultaneous efficient combustion and, perhaps more importantly, uniform combustion and pressure drop across the grate.

In one known vibrating hearth burner the grate is oscillated horizontally as fresh fuel is delivered to one end thereof. While appropriate selection of vibrating mechanism can accomplish forward motion of the fuel, it has to be carefully monitored to ensure that fresh fuel is properly ignited at the delivery end, and that burning fuel is not discharged with the ash. In such systems it can be necessary to cease the vibration on occasions to ensure proper combustion along the length of the grate. A consequence of this is increased dwell time of hot burning fuel on the grate and possible warping of the grate bars, introducing a further complication into the operation of the burner.

SUMMARY OF THE INVENTION

The present invention seeks to mitigate the above problems with known vibrating hearth burners and offers various means by which their performance may be improved. In a primary aspect, the invention contemplates means by which the movement of the fuel along the grate is gradually decelerated towards the discharge end. This results in a build up of ash towards the discharge end of the grate, affording complete combustion of the fuel and maintenance of a uniform pressure drop across the grate along its length. This affords steady extraction of combustion gases without leakage of cold air thereto. This deceleration can be achieved by varying the grate profile along its length and/or selecting an appropriate vibration mechanism. In the preferred embodiment of the invention we mount the grate on an assembly mounted for pivotal movement in a substantially vertical plane about an axis adjacent the discharge end of the grate. The assembly is resiliently supported remote from the pivot axis and vibrated by means of a mechanism mounted on the assembly at or near the support. The grate is flat and the pivotal oscillations ensure decreasing amplitudes of vibration towards the pivotal axis, resulting in deceleration of the fuel as it burns to ash and moves towards the discharge end of the grate.

As an adjunct to the achievement of uniform combustion, the present invention also contemplates the use of an ignition grate in which fuel is initially fired prior to delivery to the vibrating grate. By igniting the fuel before it reaches the grate, heat generated on the grate does not have to be used to ignite the fresh fuel. Known vibrating grate burners have had to be intermittently vibrated to enable the burning coals to ignite fresh fuel in order to avoid dead spots on the grate. Such intermittent vibration results in other problems discussed hereinafter. The benefits of using an ignition grate can also be exploited alone on known vibrating hearths to great effect.

The above two aspects of the invention are directed primarily at the problem of achieving uniform combustion on the vibrating grate. There remains the problem of ash removal. On any travelling grate hearth the ash must be removed from the discharge end of the grate. A variety of removal mechanisms may be used, but each known system requires the mechanism to operate in close proximity to the grate at which it is subject to high temperatures. Further, the mechanism must be accommodated at the front end of the burner housing, where space is often limited, especially where the grate is to replace an oil or gas burner. According to a further aspect of the present invention the vibrating grate assembly incorporates a return chute for ash along which the ash travels back towards the rear end of the burner. The vibration of the assembly causes the ash to be maintained in motion and the chute may also be inclined away from the discharge end of the grate to ensure steady despatch of ash. Conventional mechanisms may also be employed if needed, but at a location spaced from the hot discharge end of the grate. The use of an ash chute enables the burner to be operated wholly from the rear end of the housing, any ash build up at the front end providing additional insulation for the construction as a whole.

In burners according to the invention the grate preferably comprises transversely laid bars, in contrast to the longitudinally laid bars used in the prior art. This provides additional independent advantages discussed hereinafter primarily relating to the flow of combustion air, and the reduced risk of the heat generated on the grate causing distortion of the grate and consequent problems in controlling the movement of fuel along the grate.

Burners according to the invention are particularly suited to incorporation in boilers or vapour generators. A conventional heat exchanger can be located over the burner in a single body and the combustion gases drawn from the burner and through the heat exchanger by one or more induced draught fans. With the improved performance of burners according to the invention, particularly the uniform pressure drop across the grate, no forced draught ventilation of the burner need be necessary. The burner over the grate can be a substantially sealed construction, fresh fuel providing the seal at the delivery end of the grate. Notwithstanding the particular suitability of burners of the invention in boilers and vapour generators, it will be appreciated that they may be used beneficially in installations of many other types and sizes. For example, burners according to the invention may be used in parallel in the same boiler or generator.

The invention will now be described by way of example, and with reference to the accompanying drawing wherein:

DESCRIPTION OF PREFERRED EMBODIMENT

Figure 1:
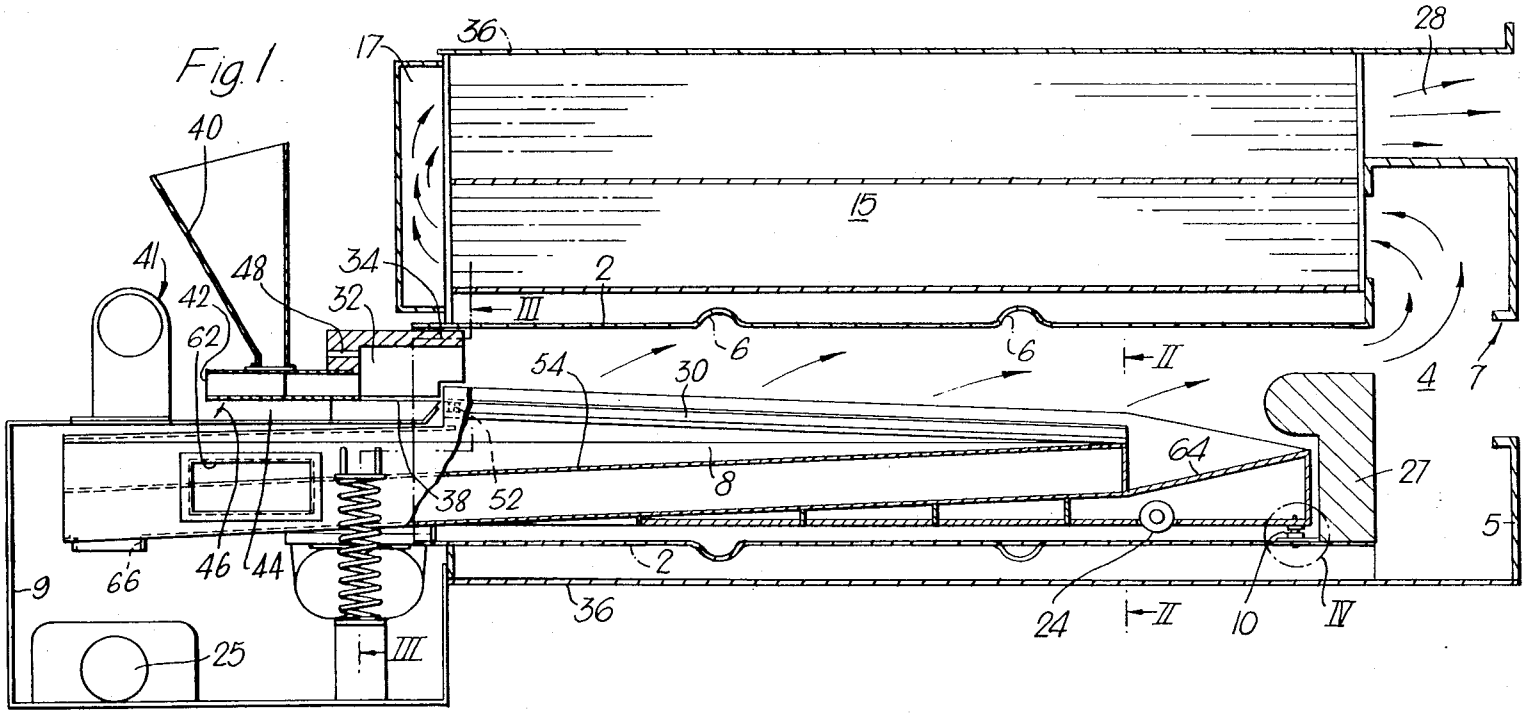
FIG. 1 is a longitudinal sectional elevation illustrating a vibrating hearth burner according to the invention installed in a boiler.
Figure 2:
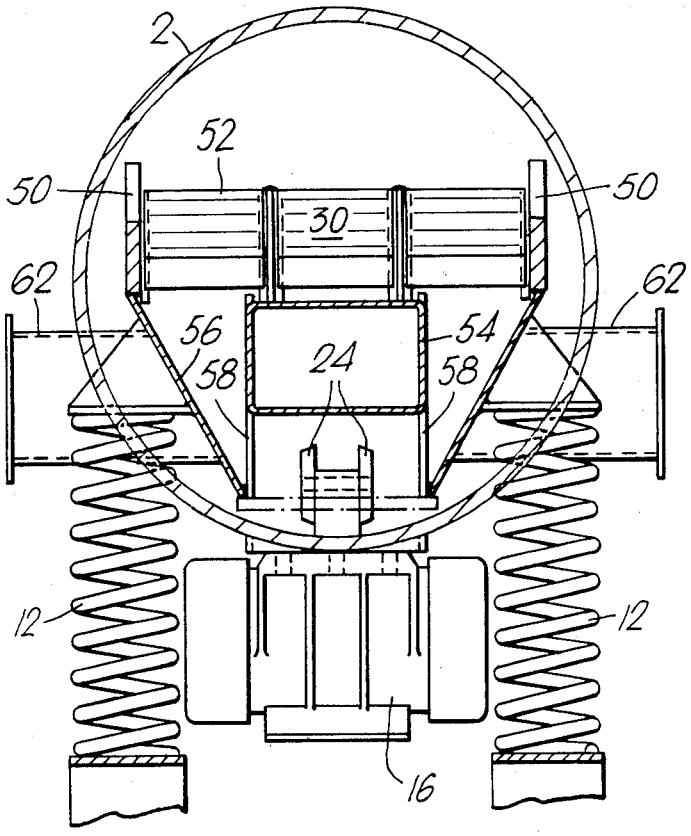
FIG. 2 is a transverse sectional elevation taken on line II—II of FIG. 1.

The vibrating hearth burner according to the invention illustrated in the drawings is substantially enclosed by a generally cylindrical housing 2 supported in the main boiler body 36. The front end 4 is closed by an end plate 5 through which an access door is available through opening 7 which is, in use, closed by a refractory plug. The main body of the housing though, does not need to include access openings, for reasons which will become apparent, and this enables it to be a unitary construction, minimizing the need for internal reinforcement, and permitting the use of a standard steel fabrication. In order to accommodate the temperature changes which will of necessity develop in use, expansion joints or annular recesses 6 are built in to the housing 2.

Within the housing 2 is supported a grate assembly 8. The assembly 8 is pivotally mounted at the front end 4 of the housing 2 on a pivotal joint 10, illustrated in more detail in FIG. 4. The rear end of the assembly 8 extends beyond the rear end of the housing 2 and is mounted on springs 12 supported on the floor or base plate 14 of a furnace end closure 9 described below, and located on either side of a vibrator 16 mounted on and beneath the assembly 8. The vibrator 16 may be of any suitable type such as magnetic, hydraulic or pneumatic, but we use an inertial vibrator in which a motor rotates wheels loaded with eccentric weights to generate the requisite substantially vertical oscillations at the rear end of the assembly 8. A suitable vibrator for the burner illustrated is a 4½ Hp twin shaft linear vibrator developing 3357 Watts at 2880 r.p.m. from a 415V-three phase 50 Hz supply. The preferred vibrator is designed not to generate any substantial forward or rearward motion of the assembly 8, but any which does develop is restrained by the pivotal mounting 10.

Figure 4:
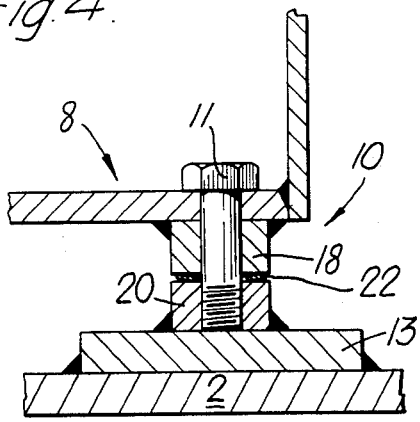
FIG. 4 is a detail view of the part IV of FIG. 1, showing the pivotal mounting of the grate at its front end.

As shown in FIG. 4, the mounting 10 includes a pair of square metal blocks 18 and 20, separated by a Belleville washer 22 held therebetween by a bolt 11 screwed directly into the lower block 20, which is welded to a baseplate 13, in turn welded to the housing 2. The upper block 18 is welded to the assembly 8 as indicated and the degree to which the bolt is tightened determines the stiffness of the mounting. As described below, the magnitude of the vibrations is never large, and the washer 22 permits sufficient pivotal movement and torsional oscillation (about the longitudinal axis of the assembly 8) while preventing the assembly from becoming unstable. Once assembled, the joint 10 permits some forward and rearward motion of the assembly 8 in the housing, but by also accommodating torsional oscillations, enables the assembly to be vibrated at and near its harmonic frequency without going out of control. The forces generated at the mounting 10 in use, are absorbed by the baseplate 13 which prevents fracture of the housing 2 adjacent thereto and the consequences thereof. Rollers 24 are mounted on the assembly 8 to facilitate location of the assembly in the housing 2.

The housing 2 is received in the lower part of the boiler body 36, the upper part of which houses a heat exchanger 15 (not shown in detail) of conventional design. In use, combustion gases from the grate pass from the burner at the front end 4 of the furnace housing 2 and pass through the heat exchanger 15, as shown by the arrows, to an outlet 28. The heat exchanger and front end of the housing 2 and body 36 are sealed by the refractory plug in opening 7 and at the rear end the gases are turned through 180° in a smoke box 17. Beneath the smoke box 17 and at the top and rear end of the housing 2 is an ignition furnace 32 having fixed upper and side walls 34 of refractory material. An ignition grate 38 is fixed at the base of the ignition furnace 32, to which the fuel is fed from a hopper 40 by means of a reciprocating feeder mechanism 41 similar to that used in the B & E coalmiser boiler available from B & E Boilers Ltd., Bracknell, Berkshire, England. The fuel is ignited in the furnace 32, whence it passes onto a grate 30 at the top of the assembly 8. The feeder piston 42 and the fuel in passage from the hopper 40 to the ignition grate 38 forms an effective seal against the ingress of air through the hopper 40 to the surface of grate 30. Air is admitted to the ignition grate 38 through a duct 44 via a damper 46, and to the upper part of the ignition furnace 32 (to assist burn off of fuel volatiles) via ducts 48, also via dampers (not shown).

The deployment of the ignition furnace 32 provides various advantages; primarily, because the fuel is already ignited before it reaches the grate 30. For this reason the forward velocity of fuel on the grate 30 is not restricted to the ignition advance velocity of the fuel being used. The forward fuel velocity on the ignition grate 38 can be adjusted to the optimum ignition advance velocity, whereas the forward fuel velocity on the vibrating grate 30 can be adjusted so that the fuel is completely burned before being discharged as ash at the end of the grate 30. This also enables the bed of fuel on the grate to be in continuous motion. With known vibrating hearth burners, the vibration has to be monitored to ensure fresh fuel is ignited and that the fire does not go out. Intermittent vibration was often the solution to this problem, but produced another; namely, settling of the bed of fuel and possible overheating of the grate. In the burner of the present invention, the vibration can be continuous, maintaining the bed of fuel always in a fluidized state and minimizing any risk of the bed settling. Related benefits of this are discussed below.

Below the level of the ignition grate 38, the rear end of the housing 2 is enclosed in a furnace end closure 9 preventing the uncontrolled ingress of air. The combustion gases are drawn from the housing 2 and through the heat exchanger and outlet 28 using an induced draught fan (not shown), and this is sufficient to maintain the requisite pressure drop across the grate 30 to ensure efficient combustion of fuel thereon. The furnace end closure 9 extends from the base of the ignition grate 38 around and under the back of the grate assembly 8 to the main boiler body 36. As will be described below, the closure 9 accommodates the inlet of air to the grate 30 and the discharge of ash, but serves primarily to preserve a negative gauge pressure around the grate assembly, inhibiting the direct passage of atmospheric air to the heat exchanger 15, and assisting in establishing the pressure drop across the grate 30.

The grate assembly is a fabricated steel construction supporting the grate 30 between side plates 50. The grate 30 is formed of cast steel or iron bars 52 extending laterally of the grate. The grate typically consists of one hundred 25×50 mm rectangular cross-section bars at 1 mm spacing. The bars are about 650 mm long and laid with their narrow faces uppermost making a total grate length of 2599 mm. The main component of the assembly 8 is a box section member 54 which extends the length of the assembly 8. The side plates 50 are secured to the box member 54 by plates 56; directly towards the rear end of the assembly 8, and through plates 58 towards the front end. The grate 30 and box member 54 converge towards the front end of the assembly 8, both terminating short of the pivotal joint 10. Additional support plates 60 for the grate 30 can be provided on the box member 54 if needed.

Figure 3:
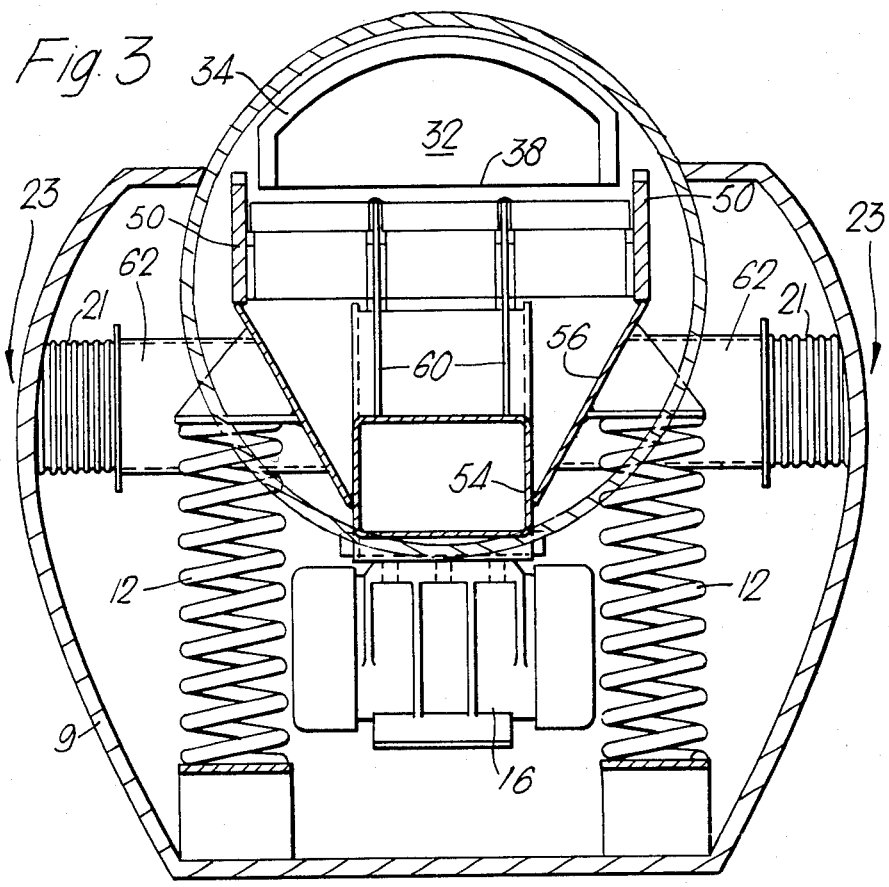
FIG. 3 is a transverse sectional elevation taken on line III—III of FIG. 1.

The air feed to the grate 30 is from within the assembly 8. Ducts 62 are coupled to the plates 56 externally of the housing 2 through flexible ducts 21 sealed to openings 23 to the atmosphere or other source of air in the furnace end closure 9 as shown in FIG. 3. Air is drawn up through the grate 30 between the bars 52 by the induced draught fan which creates a small but sufficient negative gauge pressure above the grate and in the heat exchanger 15. The transverse laying of the bars 52 also enhances the controlled fluidizing of the bed of fuel on the grate, as the air flow is effectively deprived of its forward component as it passes through the gaps between the bars 52. Additionally, the transverse laying of the bars 52 enables the profile of the grate 30 to be easily varied. For example, the grate 30 may be curved, forming a trough between its ends, the increasing slope serving to decelerate fuel as it travels on the grate. This can be particularly advantageous where the vibration mechanism employed generates a horizontal motion component and the oscillations are other thán primarily pivotal. We prefer though to use a flat grate 30 with a constant (negative) gradient.

In the rest position of the preferred burner illustrated; i.e., with the vibrator inoperative and the grate 30 loaded with fuel but supported solely on the spring 12 and pivotal joint 10, the grate 30 is normally inclined at no more than 10°, usually from 1° to 5°, and preferably 1° to 2½° to the horizontal, depending on the flow characteristics of the fuel being used, the preferred slope providing a drop of about 80 mm between the rear and front end of the grate 30. The box section is inclined in the other sense at about 2° to 7° (preferably 4° to 6°) to the horizontal. The vibrator can generate oscillations of any desired amplitude within design limits, typically up to 4 mm at 1500 cycles per minute depending on the motor speed. A typical vibration for the burner illustrated, using coal as the fuel, would be about 1.8 mm amplitude at 2000 to 2250 cycles per minute.

Because the oscillation of the assembly 8 is predominantly rotational about the joint 10, the magnitude of the vibration diminishes towards the front end. In use, fuel is delivered to the rear end of the grate 30 and the vibrations cause it to move towards the front end as it burns. The diminishing vibrations effectively decelerate the fuel towards the front end causing a build up of part-combusted fuel and ash. Because though the ash has a smaller specific volume than the unburnt or partly burnt fuel, this enables the layer of fuel and ash on the bed to maintain a substantially uniform layer along the length of the grate. The layer can thus provide a substantially uniform resistance to air flow though the bed of fuel, providing correspondingly uniform combustion and further, by suitable selection of vibrator speed, enhance complete combustion of the fuel.

The variation of vibration along the length of the grate 30 provides an additional advantage. The greater magnitude of oscillation at the rear, or feed end reduces the dwell time of the fuel on the grate. As the fuel moves down the grate as it burns, the ash content increases as does the dwell time as a consequence of the reduced vibration. The ash provides a degree of insulation between the burning fuel and the grate 30, and thus the heat transfer to the grate 30 can also be made more uniform. The bars 52 are thus less subject to distortion by heat, although by being laid transversely across the grate 30 distortion does in any event have a less severe effect on burner performance than it does in known burners where they are laid longitudinally.

In the embodiment of the invention illustrated, the box section 54 serves a particular purpose. It provides an ash discharge chute. As the fuel burns and converts to ash towards the front end of the grate, the ash is discharged. The ash falls onto a plate 64 whence ash is received in the open end of the box section 54. The incline of the box section 54 allows the ash to flow out of the housing 2 where it is discharged from the box section 54 through opening 66 for removal by suitable means such as a screw conveyor (not shown) through a sealed opening 25 in the furnace end closure 9. The box section 54 is of course in use vibrating with the assembly 8, and the vibration will encourage the passage of the ash along the chute. Additional ash removal mechanisms may though be employed if needed. While a direct ducted connection between the discharge of ash from the grate may be used, we prefer to allow the ash to build up against a refractory wall 27 in the housing 2, whence it will naturally fall into the chute. This serves to provide some insulation for the housing 2 from the heat generated on the grate 30 and more importantly, the build up of ash at the base of the wall 27 protects the pivotal joint 10.

We claim:

1. A vibrating hearth burner for burning fuel comprising:

a grate having inlet and outlet ends, said grate receiving the fuel at the inlet end thereof, a grate assembly, said grate assembly supporting said grate, a housing, said grate assembly being mounted in said housing, means for vibrating the grate assembly, wherein said grate, said grate assembly and said vibrating means are designed and arranged to move the fuel from the inlet end to the outlet end of the grate as the fuel burns and discharge the ash from the outlet end of said grate, means for decelerating said fuel and the resulting ash as said fuel and ash move from the inlet end to the outlet end of said grate, wherein said decelerating means functions to sustain a substantial uniform layer of said fuel and ash from the inlet end to the outlet end of said grate, wherein the decelerating means includes; (1) the grate assembly being pivotally mounted to the housing adjacent the outlet end of said grate and, (2) the vibrating means comprising a vibrating mechanism acting on the grate assembly adjacent said inlet end of the grate, wherein the mechanism is an inertial vibrator mounted on the grate assembly, the assembly being resiliently supported in the housing at only one location along said grate assembly, said location being closer to said inlet end than to said outlet end.

2. A vibrating hearth burner according to claim 1 wherein the grate is flat and is inclined downwards from said inlet end to said outlet end.

3. A vibrating hearth burner according to claim 2 wherein the mean inclination of the grate is in the range 0° to 10° when loaded.

4. A vibrating hearth burner comprising a grate for receiving fuel at one end thereof, and supported on a grate assembly mounted in a housing; means for vibrating the assembly to move such fuel along the grate as it burns, and discharge ash from the other end thereof, the assembly including a return chute for ash mounted therein for vibration therewith, and for receiving ash discharged from said other end of the grate and carrying ash along the assembly away from said other end of the grate for removal.

5. A vibrating hearth burner according to claim 4 wherein the return chute extends beyond said one end of the grate.

6. A vibrating hearth burner according to claim 1 or claim 4 or claim 5 wherein the grate comprises a plurality of closely spaced bars laid transversely in the grate assembly.

7. A vibrating hearth burner according to claim 6 wherein each bar is of substantially rectangular cross-section, its smaller dimension extending longitudinally of the grate.

8. A vibrating hearth burner comprising a grate assembly pivotally supported at one end thereof in a housing an supporting a combustion grate extending from said one end to a position intermediate the ends of the assembly; an ignition grate fixedly supported in the housing adjacent said position at the other end of the grate; means for delivering fuel to the ignition grate for initial firing, and thence to the combustion grate; means for pivotally vibrating the grate assembly about its said one end to move such fuel along the combustion grate as it burns, such pivotal vibration producing maximum movement of fuel along the grate adjacent said other end of the combustion grate, and lesser such movement at said one end as the fuel converts to ash, to discharge ash from said one end; and a return chute mounted in the grate assembly for vibration therewith and for receiving ash from said one end of the combustion grate, said vibration causing movement of ash along the return chute towards the other end of the grate assembly for removal.

9. A vibrating burner according to claim 1, wherein said decelerating means includes means for regulating the vibrations at said outlet end of said grate such that the vibrations at the outlet end are of a lesser amplitude than the vibrations at the inlet end of said grate.

10. A vibrating hearth burner according to claim 9, wherein the regulating means includes a pivotal connection between the grate assembly and the housing, said pivotal connection being located closer to said outlet end than said inlet end.

* * * * *